US006712941B2

(12) United States Patent
Sherril

(10) Patent No.: US 6,712,941 B2
(45) Date of Patent: Mar. 30, 2004

(54) FORMING BOARD FOR PAPERMAKING MACHINE WITH ADJUSTABLE BLADES

(75) Inventor: G. Bryan Sherril, Greeneville, TN (US)

(73) Assignee: Weavexx Corporation, Wake Forest, NC (US)

( * ) Notice: Subject to any disclaimer, the term of this patent is extended or adjusted under 35 U.S.C. 154(b) by 139 days.

(21) Appl. No.: 10/114,881

(22) Filed: Apr. 2, 2002

(65) Prior Publication Data

US 2003/0183357 A1 Oct. 2, 2003

(51) Int. Cl.[7] ..... D21F 1/54

(52) U.S. Cl. ..... 162/352; 162/354; 162/374; 162/208; 162/211; 162/355

(58) Field of Search ..... 162/352, 354, 162/374, 208, 211, 355

(56) References Cited

U.S. PATENT DOCUMENTS 4,184,915 A * 1/1980 Metcalf ..... 162/352

6,471,829 B2 * 10/2002 Frawley et al. ..... 162/352

* cited by examiner

*Primary Examiner*—Steven P. Griffin
*Assistant Examiner*—M. Halpern
(74) *Attorney, Agent, or Firm*—Myers Bigel Sibley & Sajovec

(57) ABSTRACT

A forming board for a papermaking machine includes: a support; a transversely-extending lead blade attached to the support, the lead blade; a plurality of transversely-extending trailing blades; a mounting unit for each of the plurality of trailing blades, the mounting unit being attached to a respective trailing blade and to the support such that the upper surfaces of the lead blade and the trailing blades are substantially coplanar and such that gaps are defined between the trailing edges and leading edges of adjacent blades, the gaps being of substantially uniform width; and a drive unit attached to the mounting unit and to the support, the drive unit being configured to drive the trailing blades simultaneously to different longitudinal positions relative to the support, wherein the gap widths vary but remain substantially uniform.

14 Claims, 7 Drawing Sheets

FORMING BOARD FOR PAPERMAKING MACHINE WITH ADJUSTABLE BLADES

FIELD OF THE INVENTION

This invention relates generally to papermaking, and more particularly to equipment employed with papermaking machines.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

The paper stock is fed onto the forming fabric from a device known as the "headbox", which applies a jet of stock onto the forming fabric. A "breast roll" is located beneath the headbox and serves as the upstreammost roll over which the forming fabric is conveyed. In many paper machines, and particularly more modem machines, a "forming board" is located just downstream of the breast roll, typically in the area beneath the portion of the forming fabric that receives the jet of paper stock. In this location, the forming board can support the forming fabric against deflection due to the force of the jet, and can provide well-defined drainage for the paper stock.

A typical forming board includes a series of blades (usually formed of ceramic or, more recently, polyethylene) that extend substantially parallel to one another across the width of the fabric and that are separated by gaps that extend in the cross-machine direction. The degree of open area provided by the gaps can impact the amount of drainage occurring at the forming board. Many forming boards also include a lead blade with a wedge-shaped "nose" on its leading edge that serves to "doctor" water beneath the lead blade.

Because the configuration of the forming board can impact drainage, which, in turn, can impact paper quality, the sizes of the blades and the spacing therebetween should be considered carefully during design and installation. In fact, in many paper mills, the blade positions are adjusted for each different type of paper made on the machine. Also, often the paper mill will match the forming board blade size and spacing to match that of other foil units that are positioned downstream of the forming board, and it is typically desirable to position the blades such that the gaps between blades are of uniform width. With some forming boards, the degree of open area is altered by installing blades of different widths (which can be somewhat laborious, particularly if numerous adjustments are required to attain acceptable paper machine performance). For other forming boards, spacing between blades can be adjusted manually, with each blade being repositioned and fixed into place. However, this type of adjustment can not only be time-consuming, but also may result in the spacing between blades being non-uniform. Thus, it would be desirable to provide a forming board having a configuration that would enable the open area to be adjusted without the installation of replacement blades and that would provide substantially uniform spacing between the blades automatically.

SUMMARY OF THE INVENTION

The present invention is directed to a forming board for a papermaking machine. In a first embodiment, the forming board comprises: a support; a transversely-extending lead blade attached to the support, the lead blade having an upper surface; a plurality of transversely-extending trailing blades, each of the trailing blades having an upper surface, a leading edge and a trailing edge; a mounting unit for each of the plurality of trailing blades, the mounting unit being attached to a respective trailing blade and to the support such that the upper surfaces of the lead blade and the trailing blades are substantially coplanar and such that gaps are defined between the trailing edges and leading edges of adjacent blades, the gaps being of substantially uniform width; and a drive unit attached to the mounting unit and to the support, the drive unit being configured to drive the trailing blades simultaneously to different longitudinal positions relative to the support, wherein the widths of the gaps vary but remain substantially uniform for each different longitudinal position. In this configuration, the gaps between the blades of the forming board can be maintained at substantially uniform width as the positions of the blades are adjusted for different paper grades.

In certain embodiments, the drive unit comprises a longitudinally extending positioning shaft, the positioning shaft being rotatably mounted to the support, and each trailing blade is mounted to the support via a mounting unit that engages the positioning shaft. In some of such embodiments, the positioning shaft includes a plurality of threaded sections, each of the threaded sections having a different thread pitch, and each mounting unit includes a threaded bore that is complimentary to one of the threaded sections of the positioning shaft.

As a second aspect, the present invention is directed to a forming board for a papermaking machine comprising papermaking machine, comprising: a support; a transversely-extending lead blade fixed to the support, the lead blade having an upper surface; a plurality of transversely-extending trailing blades, each of the trailing blades having an upper surface, a leading edge and a trailing edge, the blades being attached to the support such that the upper surfaces of the lead blade and the trailing blades are substantially coplanar and such that gaps are defined between the trailing edges and leading edges of adjacent blades; and a drive unit attached to the support and with the trailing blades, the drive unit being configured to drive the trailing blades simultaneously between a first position, in which the each of the gaps has a first width, the first widths of each of the gaps being substantially uniform, and a second position, in which each of the gaps has a second width that is different from the first width, the second widths of the gaps being substantially uniform.

DETAILED DESCRIPTION OF THE INVENTION

The present invention will now be described more particularly hereinafter with reference to the accompanying drawings, in which preferred embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout The dimensions and thicknesses for some components and layers may be exaggerated for clarity.

The present invention relates to a fourdrinier papermaking machine, in which paper stock is dispensed and conveyed along a processing path. In the description of the present invention that follows, certain terms are employed to refer to the positional relationship of certain structures relative to other structures. As used herein, the term "forward" and derivatives thereof refer to the general direction paper stock travels as it moves along the machine; this term is intended to be synonymous with the term "downstream", which is often used in manufacturing environments to indicate that certain material being acted upon has advanced farther along in the manufacturing process than other material. Conversely, the terms "rearward" and "upstream" and derivatives thereof refer to the directions opposite, respectively, the forward and downstream directions. Together, the forward and rearward directions comprise the "longitudinal" dimension. As used herein, the terms "outer", "outward", "lateral", and derivatives thereof refer to the direction defined by a vector originating at the longitudinal axis of a given structure and extending horizontally and perpendicularly thereto. Conversely, the terms "inner", inward", and derivatives thereof refer to the direction opposite that of the outward direction. Together, the inward and outward directions comprise the "transverse" dimension.

In addition, the discussion that follows is directed to a forming board of a paper machine. The present invention is equally applicable to a gravity foil, which is typically positioned just downstream of the forming board. Thus, when the term "forming board" is used herein, it is intended that the term include both forming board units and gravity foil units.

Figure 1:
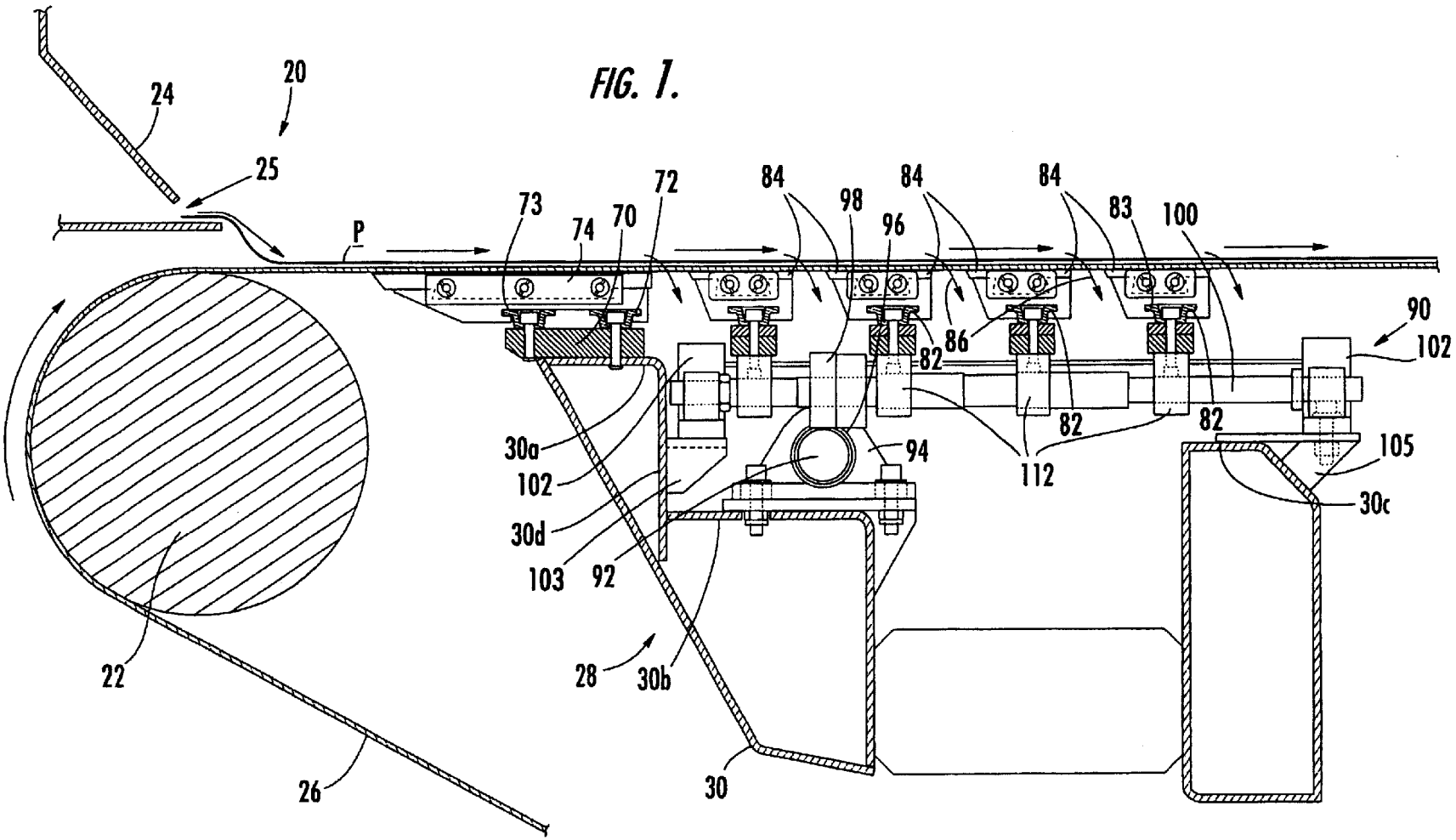
FIG. 1 is a partial side view of a papermaking machine with a forming board of the present invention.

Referring now to the figures, a fourdrinier paper machine, designated broadly at 20, is illustrated in FIG. 1. The paper machine 20 includes a head box 24 that dispenses paper stock through an outlet 25 (known in the industry as the "slice"). A transversely-extending breast roll 22 is positioned beneath the outlet 25. An endless forming fabric 26 extends longitudinally and engages the breast roll 22 at its upstreammost end. A forming board 28 is positioned below the upper surface of the forming fabric 26 just downstream of the breast roll 22. The forming board 28 includes a lead blade 74 and a plurality of trailing blades 84 (four trailing blades 84 are illustrated herein) that are disposed transversely and support the upper run of the forming fabric 28. Paper stock P is dispensed from the head box 24 onto the upper surface of the forming fabric 26, which travels around the breast roll 22 and over the blades 74, 84 of the forming board 28 as indicated by the arrows in FIG. 1.

Figure 2:
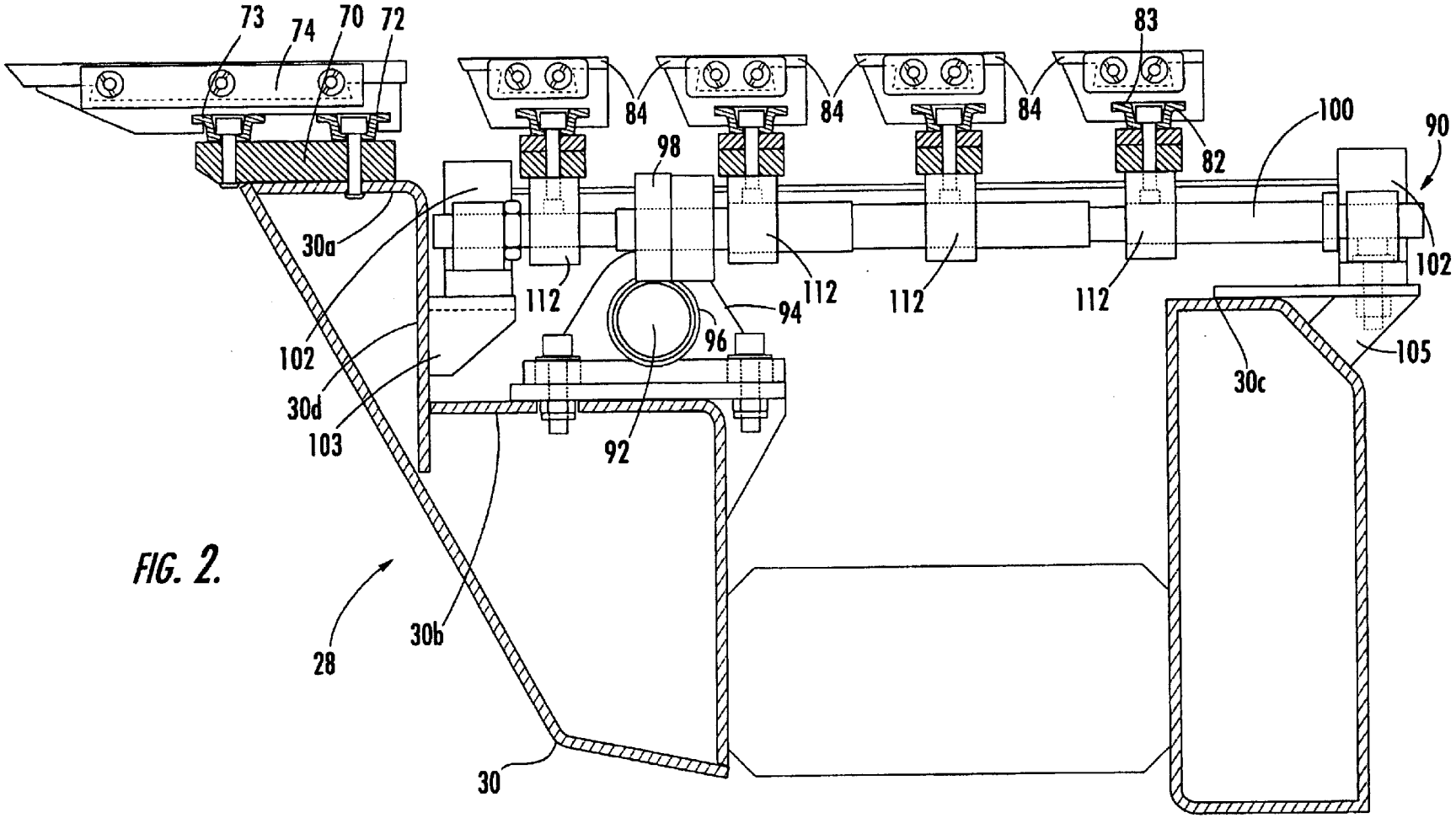
FIG. 2 is an enlarged side view of the forming board of FIG. 1, with the trailing blades in a first position in which the blades are separated by relatively narrow gaps.
Figure 3:
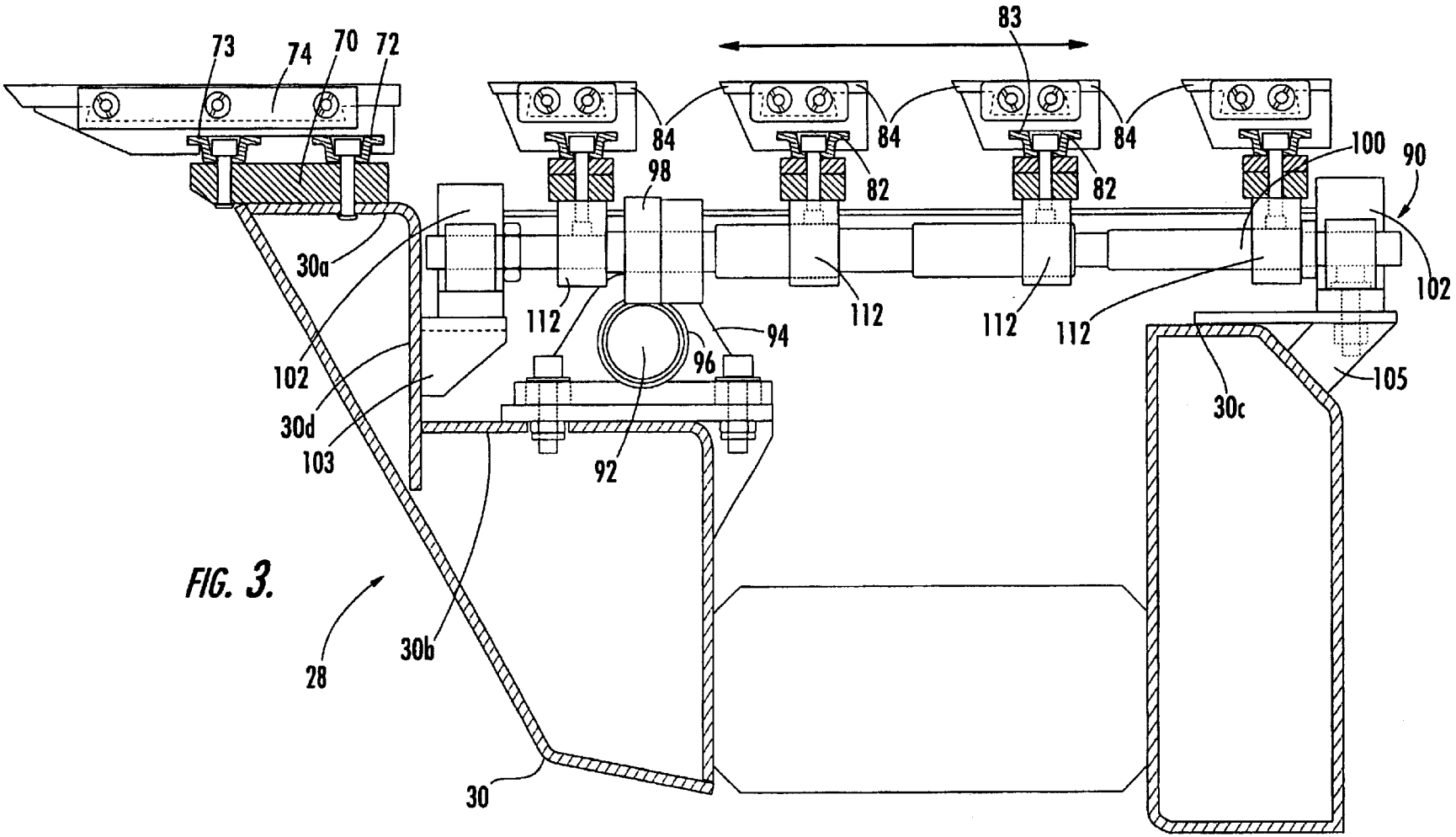
FIG. 3 is an enlarged side view of the forming board of FIG. 1, with the trailing blades in a second position, in which the blades are separated by relatively wide gaps.
Figure 4:
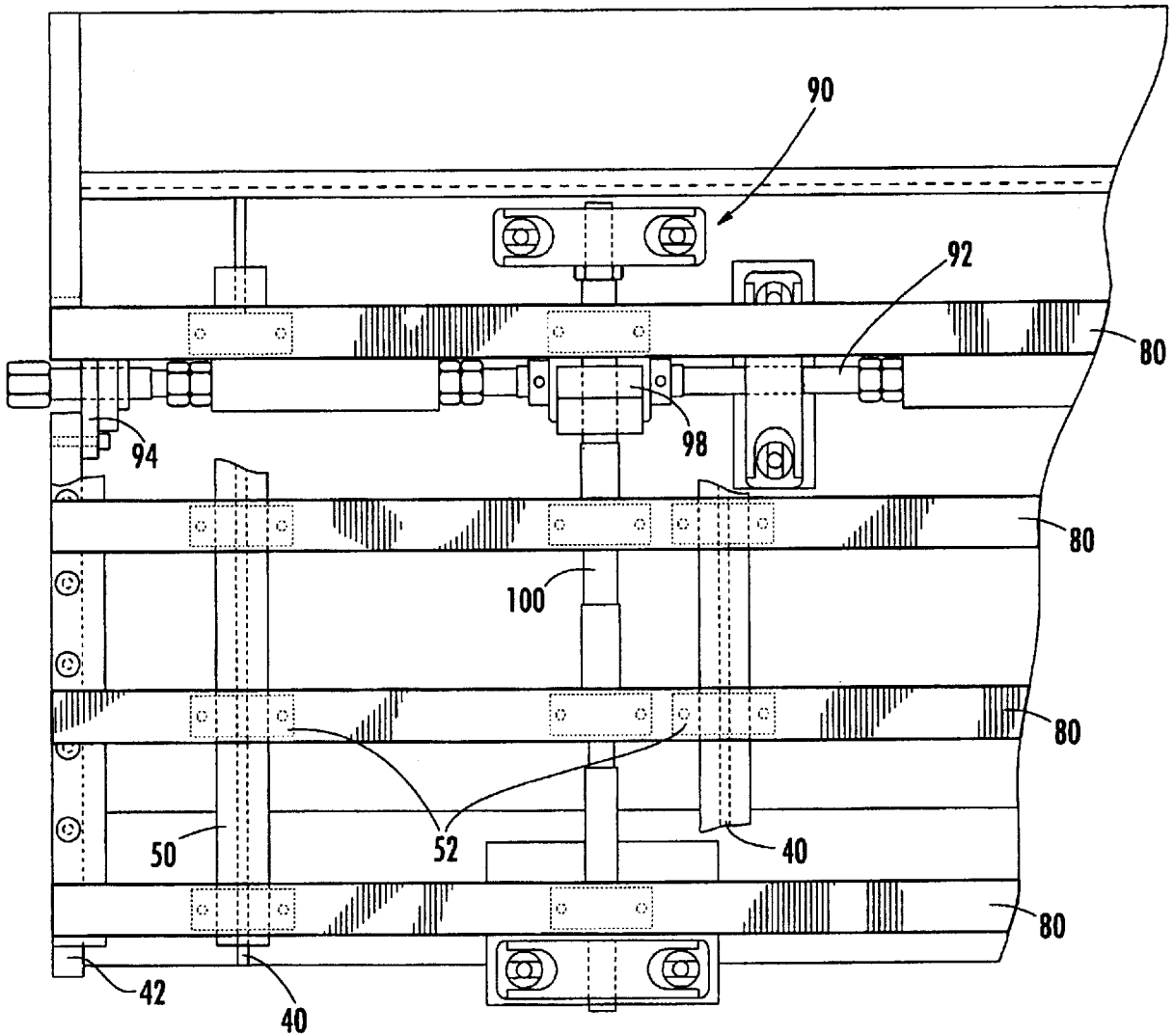
FIG. 4 is a partial cutaway top view of the forming board of FIG. 1 with the trailing blades removed.
Figure 5:
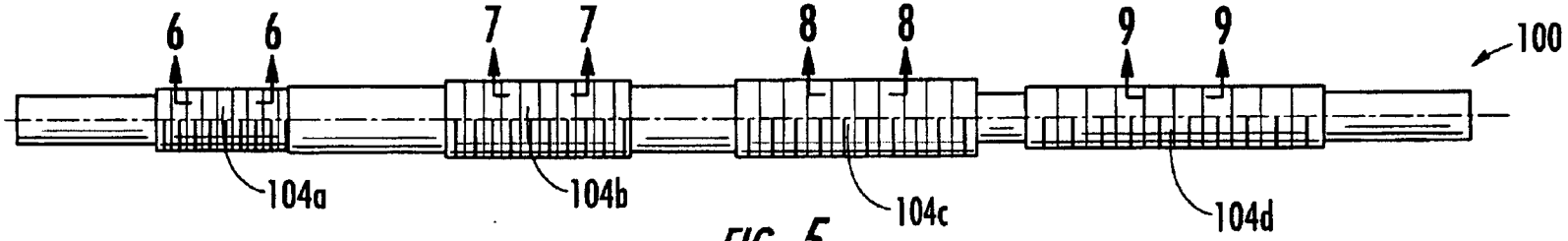
FIG. 5 is an enlarged side view of the shaft of the forming board of FIG. 1.
Figure 8:
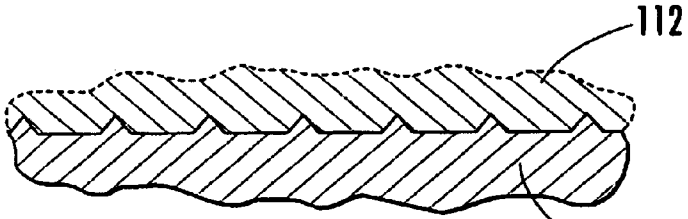
FIG. 8 is a greatly enlarged partial side view of the shaft and mounting portion of a trailing blade shown in FIG. 5 taken along lines 8—8 thereof.
Figure 9:
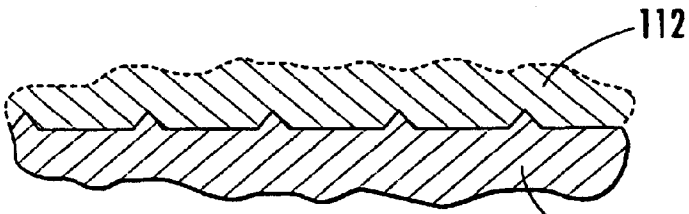
FIG. 9 is a greatly enlarged partial side view of the shaft and mounting portion of a trailing blade shown in FIG. 5 taken along lines 9—9 thereof.
Figure 6:
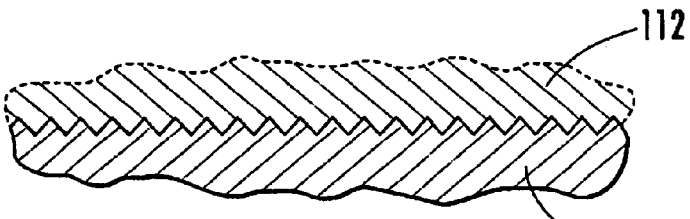
FIG. 6 is a greatly enlarged partial side view of the shaft and mounting portion of a trailing blade shown in FIG. 5 taken along lines 6—6 thereof.
Figure 7:
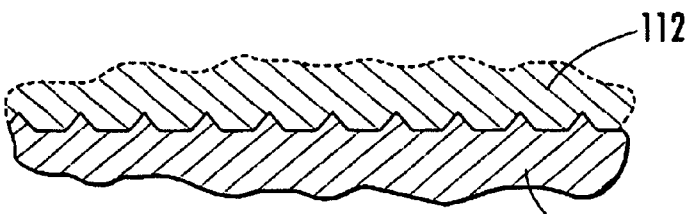
FIG. 7 is a greatly enlarged partial side view of the shaft and mounting portion of a trailing blade shown in FIG. 5 taken along lines 7—7 thereof.
Figure 10:
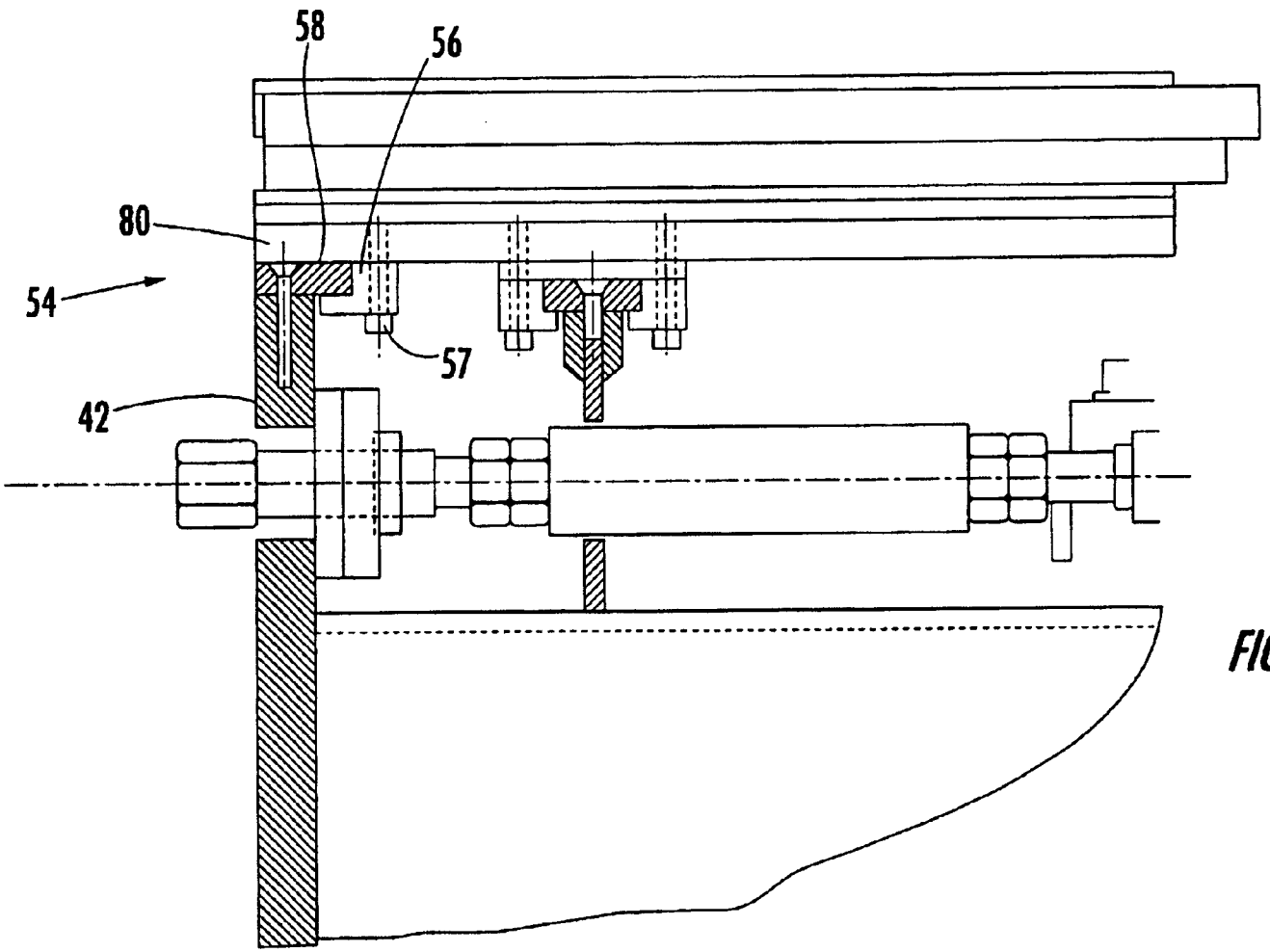
FIG. 10 is an enlarged end view of a lateral edge of the forming board of FIG. 1 supported by an end bulkhead.
Figure 12:
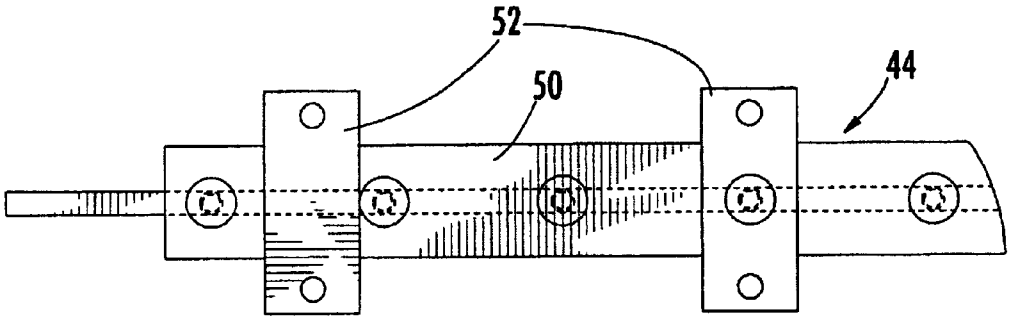
FIG. 12 is a top view of the internal bulkhead of FIG. 11.
Figure 13:
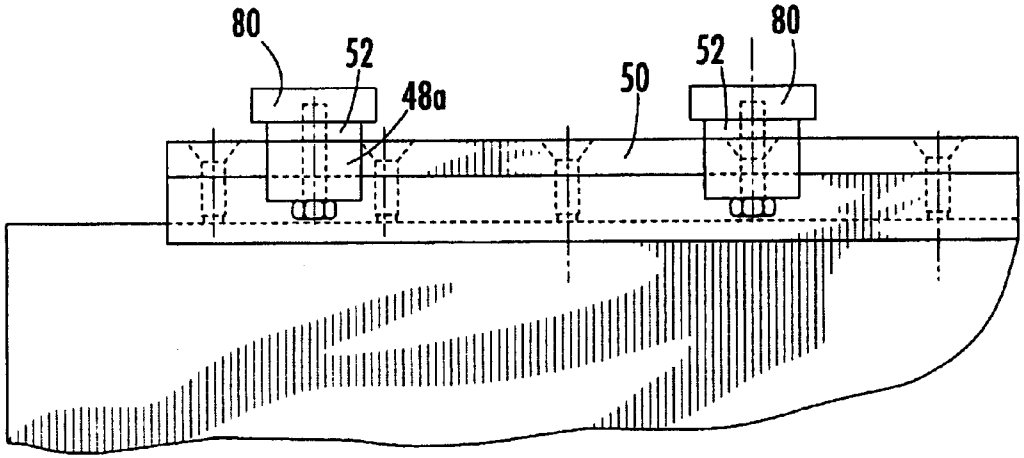
FIG. 13 is a side view of the internal bulkhead of FIG. 11.
Figure 11:
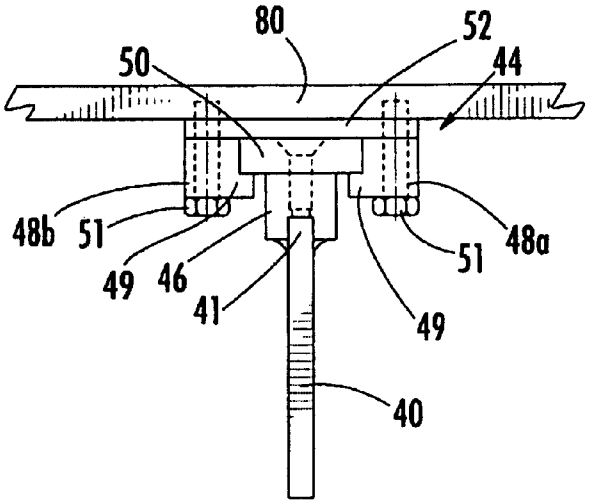
FIG. 11 is an enlarged partial end view of an internal bulkhead for supporting the forming board of FIG. 1.

Referring again to FIG. 1 and also to FIGS. 2–4, the forming board 28 includes a support 30 that is fixed relative to the head box 24 and breast roll 22. The support 30 provides mounting points for the components of the forming board 28 and can take a variety of configurations, one of which is best illustrated in FIGS. 1, 2 and 4. The support 30 shown therein includes an upstream mounting portion 30*a*, an intermediate mounting portion 30*b*, a downstream mounting portion 30*c*, internal bulkheads 40 (two of which are shown in FIG. 4 and one of which is shown in FIGS. 11–13), end bulkheads 42 (one of which is shown in FIGS. 4 and 10), and a plurality of tee bar support assemblies 44. The upstream mounting portion 30*a* provides a mounting location for the lead blade 74, each of the intermediate and downstream mounting portions 30*b*, 30*c* defines a mounting platform for a portion of a blade positioning assembly 90, and the internal and end bulkheads 40, 42 provide mounting locations for the trailing blades 84. These components are described in greater detail below.

Referring to FIGS. 11–13, in which an exemplary internal bulkhead 40 is shown, each internal bulkhead 40 includes a longitudinally-extending, vertically-projecting upper end 41 upon which a tee bar support assembly 44 is mounted. The tee bar support assembly 44 includes a base member 46 that is fixed (typically welded) to the upper end 41 and extends longitudinally. A slide plate 50 (typically formed of TEFLON® polymer or another low friction material) extends longitudinally and rests atop the base member 46. A plurality of transversely-extending tee bar supports 52 rest upon the upper surface of the slide plate 50 at spaced intervals, with their transverse edges extending beyond the transverse edges of the slide plate 50.

The tee bar supports 52 are positioned and spaced such that each aligns along a transverse axis with tee bar supports 52 mounted on other internal bulkheads 40 (see FIGS. 4 and 11–13). One of four trailing blade support bars 80 overlies each set of aligned tee bar supports 52 and extends transversely to span the distance between the end bulkheads 42.

The trailing blade support bars 80 are held in place with pairs of capture members 48*a*, 48*b*. The capture members 48*a*, 48*b* are fastened to the underside of the tee bar supports 52 with bolts 51 that are inserted through the capture members 48*a*, 48*b*, into and through the tee bar supports 52, and into the trailing blade support bars 80. Each of the capture members 48*a*, 48*b* has a small lip 49 that underlies the underside of the slide plate 50, such that the slide plate 50 is clamped between the capture members 48*a*, 48*b* and the tee bar support members 52, but is free to slide thereon upon loosening of the bolts 51.

Referring now to FIG. 10, each end bulkhead 42 supports the ends of the trailing blade support bars 80 through an end slide assembly 54. The end slide assembly 54 includes a slide plate 58 that extends longitudinally and overhangs the end bulkhead 42 inwardly. The trailing blade support bars 80 rest upon the upper surface of the slide plate 58 and are clamped thereto by capture members 56 bolted via bolts 57 to the underside of the trailing blade support bars 80.

Referring now back to FIGS. 1–3, the trailing blades 84 (usually between 2 and 7 are employed in a paper machine, and herein four are illustrated) are attached to the support 30 via a series of trailing blade capture members 82, each of which is fixed to the upper surface of each trailing blade support bar 80. The trailing blade capture member 82 has an upwardly-extending T-shaped cross-sectional projection 83. The trailing blades 84 include a complimentary T-shaped cavity that receives the projection 83 such that the trailing blades 84 can be slid transversely onto the trailing blade capture member 83. Gaps 86 are formed between the trailing and leading edges of adjacent blades. The trailing blades 84 are typically between about 2.5 and 4.0 inches in width, and the gaps 86 are typically between about 0.75 and 1.75 inches.

Referring again to FIG. 1, the lead blade 74 is attached to the support 30 via a transversely-extending lead blade support bar 70, which rests on the upstream mounting portion 30*a* of the support 30. Two capture members 72, each with an upwardly-extending T-shaped projection 73, are positioned above and fixed to the support bar 70. The lead blade 74 can be slid transversely into place on the capture member 72 in much the same manner as the trailing blades 84 are attached to the capture members 82.

Referring again to FIG. 1 and also to FIG. 4, the positioning assembly 90 includes a transversely-extending drive shaft 92. The drive shaft 92 is rotatably mounted in drive shaft bearings 94 that are fixed to the intermediate mounting portion 30*b* of the support 30. The drive shaft 92 has a worm portion 96. A positioning shaft 100 extends longitudinally and is mounted in two positioning shaft bearings 102, one of which is fixed to a vertical panel 30*d* between the upstream and intermediate mounting portions 30*a*, 30*b* via a bracket 103, and the other of which is fixed to the downstream mounting portion 30*c* via a bracket 105. The positioning shaft 100 has a toothed portion 98 that engages and is driven by the worm portion 96 of the drive shaft 92. In addition, the positioning shaft 100 has four threaded portions 104*a*, 104*b*, 104*c*, 104*d* (see FIGS. 6–9). Each of the threaded portions 104*a*, 104*b*, 104*c*, 104*d* resides directly beneath a respective trailing blade 84. A threaded positioning nut 112 or other mounting unit depends from the support bar 82 of each of the trailing blades 84 and receives a respective threaded portion 104*a*, 104*b*, 104*c*, 104*d*.

As shown in FIGS. 6–9, the thread pitch on each of the threaded portions 104*a*, 104*b*, 104*c*, 104*d* differs (and, in turn, the thread pitch of each positioning nut 112 matches that of its mating threaded portion), with the result that, as the positioning shaft 100 rotates within its bearings 102, the positioning nuts are driven longitudinally different longitudinal distances. Consequently, the trailing blades 84 move different longitudinal distances. The thread pitches of the threaded portions 104*a*, 104*b*, 104*c*, 104*d* are selected so that, as the trailing blades 84 move, the gaps 86 between the adjacent edges of the trailing blades 84 widen or narrow, but remain substantially uniform with each other. As an example, the diameters and pitches of the threaded portions 104*a*, 104*b*, 104*c*, 104*d* can be selected as shown in Table 1 below.

TABLE 1

| Threaded Portion # | Shaft Diameter (in) | Thread Pitch (threads/in) |
|---|---|---|
| 104a | 0.75 | 32 |
| 104b | 1.00 | 16 |
| 104c | 1.00 | 10.667 |
| 104d | 0.75 | 8 |

Those skilled in this art will recognize that other combinations of shaft diameter and thread pitch will also enable the gaps between the trailing blades 84 to remain substantially uniform as they change in width.

Adjustment of the trailing blades 84 is achieved by rotating the drive shaft 92. This can be accomplished with a drive motor (not shown) or by manual rotation of the drive shaft 92 with a handle (also not shown). Rotation of the drive shaft 92 causes the worm portion 96 to rotate. Because the toothed portion 98 of the positioning shaft 100 engages the worm portion 96, the positioning shaft 100 rotates also. Rotation of the positioning shaft 100 and its threaded portions 104*a*, 104*b*, 104*c*, 104*d* drives the trailing blades 84 to different longitudinal positions, but the gaps 86 remain substantially uniform with each other. The trailing blades 84 are free to move longitudinally relative to the internal and end bulkheads 40, 42 due to the sliding interaction between the slide plates 50, 58 and, respectively, the tee bar supports 52, 60 and their capture members 48*a*, 48*b*, 56.

Those skilled in this art will appreciate that other forming board configurations may also be suitable for use with the present invention. For example, different numbers of trailing blades may be employed; they may have different widths, or the gaps therebetween may have different widths. Further, the support on which the forming board is mounted may have a different configuration, depending on the configuration of the blades. The positioning unit may also take a different configuration; for example, the positioning shaft may be driven directly with a crank or other rotating device, or the drive shaft may be coupled to the positioning shaft through other design techniques. Also, the positioning unit may be configured such that multiple positioning shafts are used in order maintain uniformity of gaps between the trailing blades. The configuration of the tee bar assembly may also differ, although the unit should support the trailing blades from beneath and allow them to be driven longitudinally.

The foregoing embodiments are illustrative of the present invention, and are not to be construed as limiting thereof. The invention is defined by the following claims, with equivalents of the claims to be included therein.

What is claimed is:

1. A forming board for a papermaking machine, comprising:

a support;

a transversely-extending lead blade attached to the support, the lead blade having an upper surface;

a plurality of transversely-extending trailing blades, each of the trailing blades having an upper surface, a leading edge and a trailing edge, the blades being attached to the support such that the upper surfaces of the lead blade and the trailing blades are substantially coplanar and such that gaps arc defined between the trailing edges and leading edges of adjacent blades, the gaps being of substantially uniform width; and a drive unit attached to the support and with the trailing blades, the drive unit being configured to drive the trailing blades simultaneously to different longitudinal positions relative to the support, wherein the widths of the gaps vary but remain substantially uniform to each other for each different longitudinal position;

wherein the drive unit comprises a longitudinally extending positioning shaft, the positioning shaft being rotatably mounted to the support, and wherein each trailing blade is mounted to the support via a mounting unit that engages the positioning shaft; and wherein the positioning shaft includes a plurality of threaded sections, each of the threaded sections having a different thread pitch, and wherein each mounting unit includes a threaded bore that is complimentary to one of the threaded sections of the positioning shaft.

2. The forming board defined in claim 1, wherein the drive unit further comprises a drive shaft having a worm portion coupled to the positioning shaft.

3. The forming board defined in claim 1, wherein the width of the gaps is between about 0.75 and 1.75 inches.

4. The forming board defined in claim 1, wherein the plurality of tailing blades comprises between 2 and 7 trailing blades.

5. The forming board defined in claim 1, wherein the upper surfaces of the trailing blades are between about 2.5 and 4 inches in width.

6. The forming board defined in claim 1, wherein the lead blade is fixed to the support.

7. The forming board defined in claim 1, wherein the support comprises a plurality of longitudinally-extending slide plates, and wherein the trailing blades slide relative to the slide plates were driven by the drive unit.

8. A forming board for a papermaking machine, comprising:

a support;

a transversely-extending lead blade fixed to the support, the lead blade having an upper surface;

a plurality of transversely-extending trailing blades, each of the trailing blades having an upper surface, a leading edge and a trailing edge, the blades being attached to the support such that the upper surfaces of the lead blade and the trailing blades are substantially coplanar and such that gaps are defined between the trailing edges and leading edges of adjacent blades; and a drive unit attached to the support and with the trailing blades, the drive unit being configured to drive the trailing blades simultaneously between a first position, in which the each of the gaps have a first width, the first widths of each of the gaps being substantially uniform, and a second position, in which each of the gaps has a second that the upper surfaces of the lead blade and the trailing blades are substantially coplanar and such that gaps are defined between the trailing edges and leading edges of adjacent blades; and a drive unit attached to the support and with the trailing blades, the drive unit being configured to drive the trailing blades simultaneously between a first position, in which the each of the gaps has a first width, the first widths of each of the gaps being substantially uniform, and a second position, in which each of the gaps has a second width that is different from the first width, the second widths of the gaps being substantially uniform;

wherein the drive unit comprises a longitudinally-extending positioning shaft, the shaft being rotatably mounted to the support, and wherein each trailing blade is mounted to the support via a mounting unit that engages the positioning shaft; and wherein the positioning shaft includes a plurality of threaded sections, each of the threaded sections having a different thread pitch, and wherein each mounting unit includes a threaded bore that is complimentary to one of the threaded sections of the positioning shaft.

9. The forming board defined in claim 8, wherein the drive unit further comprises a drive shaft having a worm portion coupled to the positioning shaft.

10. The forming board defined in claim 8, wherein the width of the gaps is between about 0.75 and 1.75 inches.

11. The forming board defined in claim 8, wherein the plurality of trailing blades comprises between 2 and 7 trailing blades.

12. The forming board defined in claim 8, wherein the upper surfaces of the trailing blades are between about 2.5 and 4 inches in width.

13. The forming board defined in claim 8, wherein the lead blade is fixed to the support.

14. The forming board defined in claim 8, wherein the support comprises a plurality of longitudinally-extending, slide plates, and wherein the trailing blades slide relative to the slide plates were driven by the drive unit.

* * * * *

UNITED STATES PATENT AND TRADEMARK OFFICE

CERTIFICATE OF CORRECTION

PATENT NO. : 6,712,941 B2
DATED : March 30, 2004
INVENTOR(S) : G. Bryan Sherrill It is certified that error appears in the above-identified patent and that said Letters Patent is hereby corrected as shown below:

Title page,
Item [75], Inventor, should read -- G. Gryan Sherrill --

Column 8,
Delete lines 8-17.

Signed and Sealed this

Thirtieth Day of November, 2004

JON W. DUDAS
*Director of the United States Patent and Trademark Office*